US006784443B2

(12) United States Patent
Pennington et al.

(10) Patent No.: US 6,784,443 B2
(45) Date of Patent: Aug. 31, 2004

(54) STORAGE VESSELS AND RELATED CLOSURE METHODS

(75) Inventors: Charles W. Pennington, Alpharetta, GA (US); George C. Carver, Suwanee, GA (US)

(73) Assignee: NAC International, INC, Norcross, GA (US)

( * ) Notice: Subject to any disclaimer, the term of this patent is extended or adjusted under 35 U.S.C. 154(b) by 372 days.

(21) Appl. No.: 09/746,156

(22) Filed: Dec. 22, 2000

(65) Prior Publication Data

US 2001/0032851 A1 Oct. 25, 2001

Related U.S. Application Data

(60) Provisional application No. 60/175,444, filed on Jan. 11, 2000.

(51) Int. Cl.[7] ..... G21F 5/00

(52) U.S. Cl. ..... 250/506.1; 250/507.1; 250/518.1; 376/403

(58) Field of Search ..... 250/506.1, 507.1, 250/518.1; 376/403, 412; 588/1; 518/1

(56) References Cited

U.S. PATENT DOCUMENTS

| | | | | | |
|---|---|---|---|---|---|
| 4,016,096 | A | * | 4/1977 | Meyer | 588/16 |
| 4,164,178 | A | * | 8/1979 | Baumann et al. | 100/99 |
| 4,330,711 | A | * | 5/1982 | Ahner et al. | 250/506.1 |
| 4,528,454 | A | * | 7/1985 | Baatz et al. | 250/506.1 |
| 4,535,250 | A | * | 8/1985 | Fields | 250/507.1 |
| 4,633,091 | A | * | 12/1986 | Kurasch et al. | 250/506.1 |
| 4,698,510 | A | * | 10/1987 | Handke et al. | 250/506.1 |
| 4,783,309 | A | * | 11/1988 | Popp et al. | 376/272 |
| 4,810,890 | A | * | 3/1989 | Blum | 250/506.1 |
| 5,181,626 | A | * | 1/1993 | Daenen et al. | 220/282 |
| 5,667,268 | A | * | 9/1997 | Bump | 296/37.6 |
| 5,797,523 | A | * | 8/1998 | Gross | 222/498 |
| 6,489,623 | B1 | * | 12/2002 | Peters et al. | 250/506.1 |

FOREIGN PATENT DOCUMENTS

| | | | | |
|---|---|---|---|---|
| DE | 3905870 | * | 8/1990 | B65D/43/26 |

* cited by examiner

*Primary Examiner*—Nikita Wells
*Assistant Examiner*—Anthony Quash
(74) *Attorney, Agent, or Firm*—Thomas, Kayden, Horstemeyer & Risley, LLP

(57) ABSTRACT

A preferred storage system includes a container, a closure lid, and a compression link. Preferably, the container includes an outer wall, which defines an interior, and a first open end. The closure lid is configured to be inserted within the open end of the container, and is adapted to engage in a sealing relationship with the outer wall of the container. Preferably, the compression link includes a container engagement surface and a closure lid engagement surface. The compression link is configured to engage between the closure lid and the outer wall of the container to retain the closure lid in sealing engagement with the container. The container engagement surface and the closure lid engagement surface are configured to extend outwardly from each other, with the container engagement surface being adapted to engage the outer wall of the container and the closure lid engagement surface being adapted to engage the closure lid. Methods also are provided.

35 Claims, 4 Drawing Sheets

STORAGE VESSELS AND RELATED CLOSURE METHODS

CROSS-REFERENCE TO RELATED APPLICATIONS

This application is based on and claims priority to U.S. Provisional Application Ser. No. 60/175,444, filed on Jan. 11, 2000, which is incorporated by reference herein in its entirety.

BACKGROUND OF THE INVENTION

1. Field of the Invention

The present invention generally relates to storage vessels and related closure techniques. More specifically, the present invention relates to storage vessels which facilitate the use of non-welded closure techniques for sealing the storage vessels and related methods.

2. Description of the Related Art

Nuclear fuel discharged from fission reactors, referred to hereinafter as Spent Nuclear Fuel (SNF), typically is stored in deep pools filled with water, with the water being provided to dissipate heat and to attenuate gamma and neutron radiation generated by the SNF. As an alternative to storing SNF in water-filled pools ("wet storage"), "dry storage" techniques also have been utilized.

In a typical dry-storage application, the SNF is stored in a substantially horizontal or substantially vertical configuration within a protective vessel, such as a "cask" or "overpack," which typically includes a heavy-walled structure. Additionally, the SNF may be stored in a thin-walled vessel (referred to hereinafter as a canister) which then may be placed into a cask. Such dry storage applications are widely viewed as possessing the necessary characteristics to enable economical long-term storage of SNF.

Typically, a cylindrical canister utilized in dry-storage applications incorporates two lids, in addition to a bottom closure, for promoting a final sealing of the canister. These two lids are utilized for providing redundancy as well as enhancing protection against leakage of internally stored contents. Heretofore, each of the lids typically is welded to the shell of the canister with the welding of the lids typically being performed at the location where the SNF is loaded into the canister, such as at a nuclear facility. Typically, in order to facilitate sealing of the canister by welding, special welding, testing, and inspection equipment is made available and specially trained and qualified personnel are utilized to assure that high quality welds for sealing the lids to the canister shell are achieved. Thus, welding of the lids typically is a very expensive and time intensive process that may potentially result in increased radiation exposure to personnel, e.g., the personnel performing the welding.

Therefore, there is a need for improved storage systems and methods which address these and other shortcomings of the prior art.

SUMMARY OF THE INVENTION

Briefly described, the present invention relates to storage vessels and related closure techniques. More specifically, the present invention relates to storage vessels which facilitate the use of non-welded closure techniques for sealing the storage vessels and related methods. In this regard, a preferred embodiment of the present invention may be construed as providing a storage system which includes a container, a closure lid, and a compression link. Preferably, the container includes an outer wall, which defines an interior, and a first open end. The closure lid is configured to be inserted within the open end of the container, and is adapted to engage in a sealing relationship with the outer wall of the container. Preferably, the compression link includes a container engagement surface and a closure lid engagement surface. The compression link is configured to engage between the closure lid and the outer wall of the container to retain the closure lid in sealing engagement with the container. The container engagement surface and the closure lid engagement surface are configured to extend outwardly from each other, with the container engagement surface being adapted to engage the outer wall of the container and the closure lid engagement surface being adapted to engage the closure lid. So configured, the closure lid may be retained in sealing engagement with the outer wall.

In some embodiments, a material, such as spent nuclear fuel, for example, may be inserted within the container and sealed therein.

In another embodiment, the storage system includes a container, a closure lid, and means for retaining the closure lid in sealing engagement with the outer wall.

Some embodiments may be construed as providing methods for storing a material. In a preferred embodiment, the method comprises the steps of: (1) providing a container having a first open end and defining an interior; (2) providing a closure lid adapted to be received within the open end; and (3) sealing the closure lid to the container by placing a portion of the closure lid under compression and a corresponding portion of the outer wall under tension.

Other features and advantages of the present invention will become apparent to one with skill in the art upon examination of the following drawings and detailed description. It is intended that all such features and advantages be included herein within the scope of the present invention, as defined in the appended claims.

BRIEF DESCRIPTION OF THE SEVERAL VIEWS OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION OF THE PREFERRED EMBODIMENTS

Figure 1:
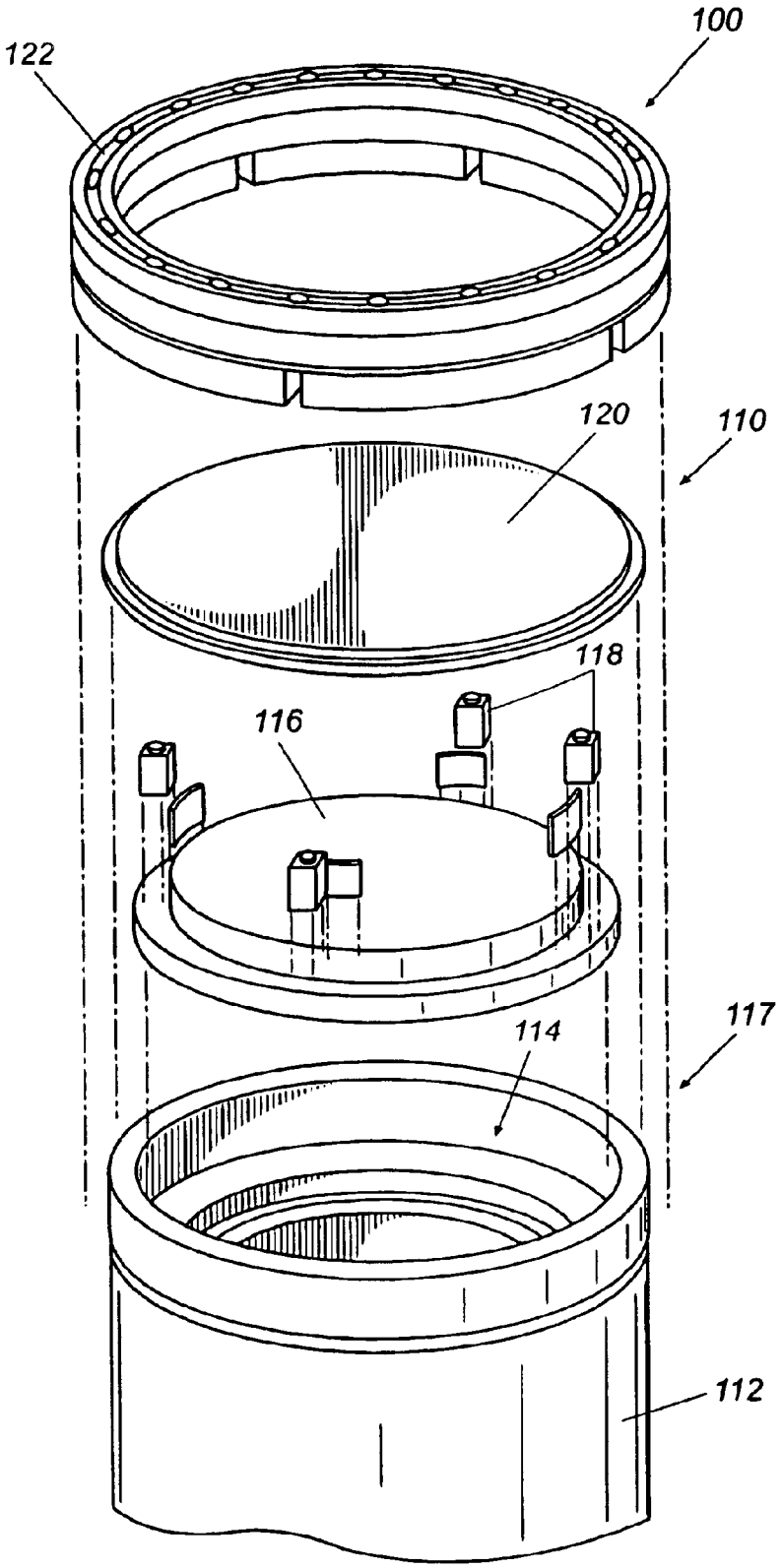
FIG. 1 is a partially cut-away, partially exploded, perspective view of a preferred embodiment of the present invention.

Reference will now be made in detail to the description of the invention as illustrated in the drawings with like numerals indicating like parts throughout the several views. As described in detail hereinafter, the present invention provides storage systems and methods utilizing non-welded closure techniques. Although the present invention will be described herein in relation to the storage of SNF, it should be understood that the teachings of the present invention are not so limited and, in particular, the present invention may be utilized in various other storage applications.

Referring now to FIG. 1, a preferred embodiment of the storage system 100 will now be described in detail. As depicted therein, storage system 100 incorporates a canister 110 which includes an outer wall or shell 112 and a bottom (not shown) that cooperate to define an interior 114 which is suitable for the storage of materials therein. Additionally, a closure lid 116 is adapted to be received within an open end 117 of the canister and form a seal therewith for containing materials within the interior of the canister. Preferably, one or more compression members or links 118 (described in detail hereinafter) are provided for urging or forcing the closure lid into sealing engagement with the canister.

Figure 2:
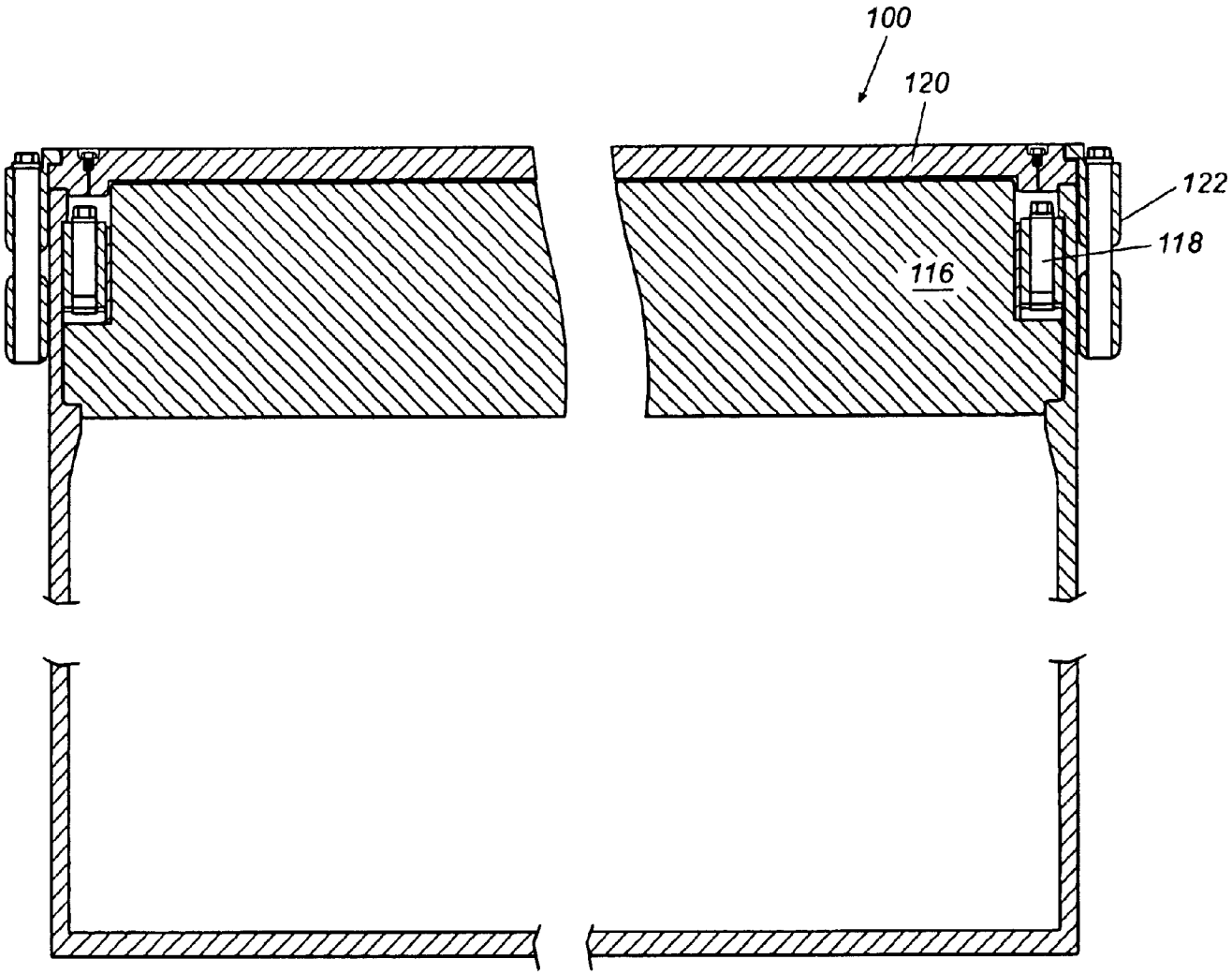
FIG. 2 is a partially cut-away, cross-sectional, side view of a preferred embodiment of the present invention.

In some embodiments, an outer lid 120 cooperates with a open end 117 of the canister so that a redundant seal of the storage system is provided. Preferably, the outer lid is retained in sealing engagement with the distal end of the canister by a hold-down member 122 (described in detail hereinafter). As depicted in FIG. 2, the canister 110, closure lid 116 and compression links 118, and, in embodiments so provided, outer lid 120 and hold-down member 122, cooperate to provide a non-welded closure system 100. System 100 may, in some embodiments, offer one or more advantages over classical bolted closures which typically require a flanged surface or ledge. Such a ledge typically protrudes beyond the shell of a canister or, in other embodiments, encroaches upon the opening of the canister, in order to provide a significantly strong and sizable surface to allow bolts, which are adapted to secure the lid to the canister, to be placed therethrough. In regard to bolted closures utilizing flanges that extend beyond the canister shell, such a configuration typically provides access to the full opening of the canister; however, typically only a single lid closure may be utilized. In regard to those embodiments which utilize flanges which encroach upon the opening of the canister, such a configuration tends to preclude the use of outer or peripheral regions of the canister interior.

Referring now to FIG. 2, the embodiment of the closure lid 116 depicted therein is adapted to permit a basket or other suitable structure to receive a material to be stored, such as SNF, for example. A basket for storing SNF, for example, typically comprises vertical and lateral support members which may be combined with neutron absorbers. These features provide structural support to the SNF so that a correct, predetermined geometry of the SNF is maintained under both normal and accident conditions, thereby ensuring that heat transfer and nuclear critically requirements are maintained. Various configurations of baskets and other material support structures may be utilized to perform the aforementioned functionality as may be required based upon the particular application, with all such configurations considered well within the scope of the present invention.

Figure 4:
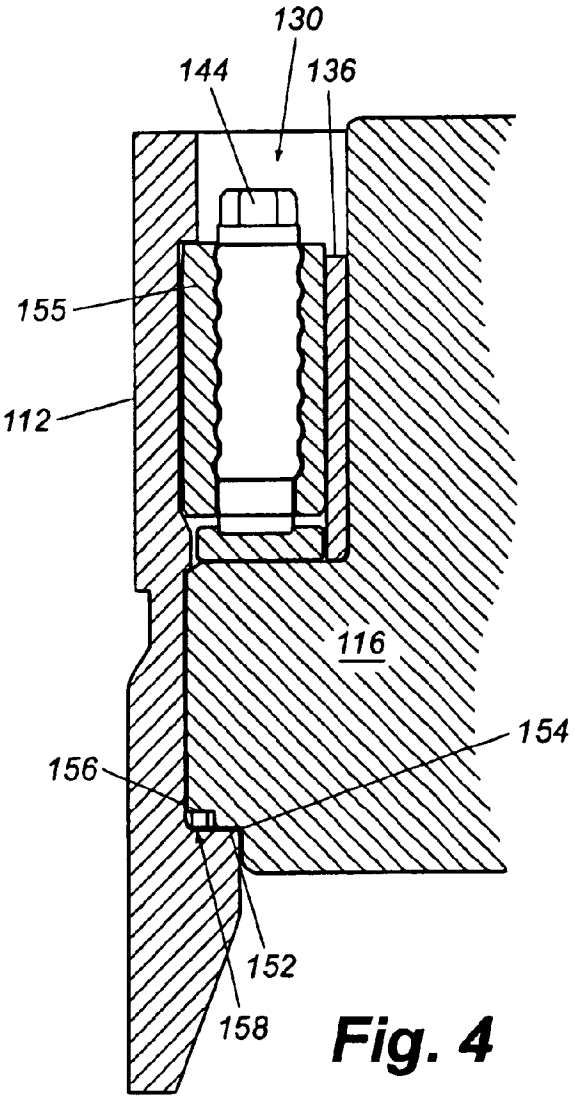
FIG. 4 is a partially cut-away, cross-sectional, side view showing detail of a preferred closure lid of the present invention.
Figure 3:
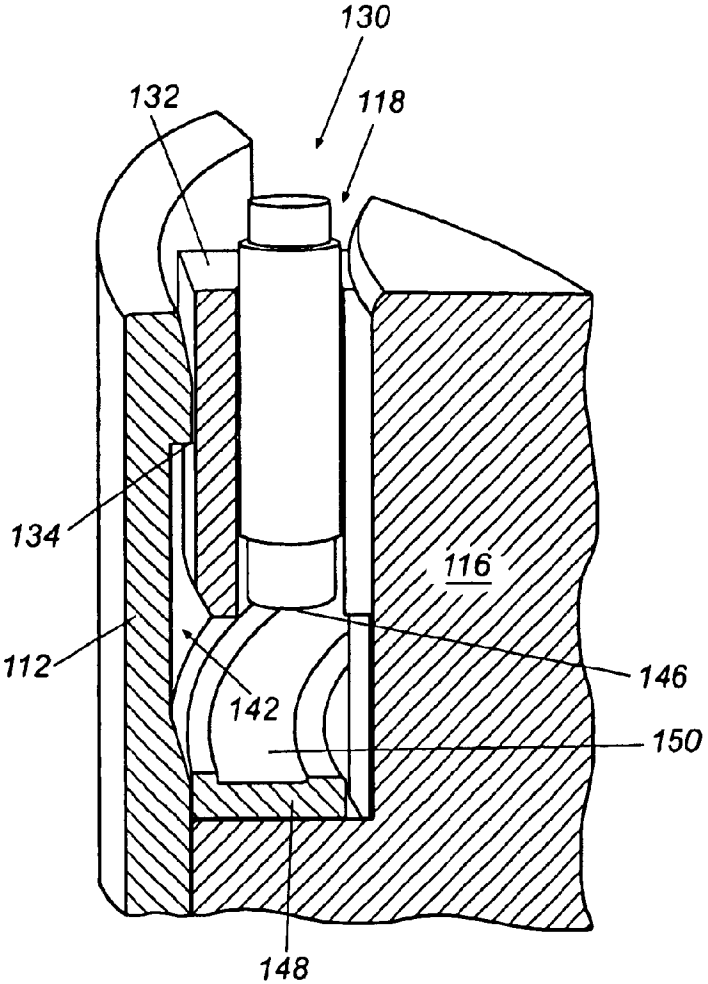
FIG. 3 is a partially cut-away, partially cross-sectional, perspective view showing detail of a preferred closure lid of the present invention.

Referring now to FIGS. 3 and 4, closure lid 116 and its associated components will now be described in greater detail. As shown in FIG. 3, closure lid 116 cooperates with canister shell 112 to form an annular space or region 130. Compression links 118 are adapted to be inserted between the canister shell 112 and closure lid 116 within the annular region 130. As shown in greater detail in FIG. 4, once a compression link 118 is inserted within the annular region 130, the compression link preferably is urged radially outwardly so that an upper or engagement surface 132 of the compression link is positioned below a closure lid-retention surface 134 formed in canister shell 112. Preferably, urging of the compression link radially outwardly is facilitated by inserting a backing ring or wedge 136 between a surface of the closure lid and an exterior surface of the compression link, thereby allowing a portion of the compression link to be received within retention recess 142 of the canister shell 112.

Once appropriately positioned with the retention recess, drive bolt 144 of the compression link may be driven so that a distal end 146 of the drive bolt is urged downwardly toward the closure lid. Preferably, although not required, that portion of the closure lid which is intended to receive or engage the distal end 146 of the drive bolt is configured with a hardened surface which is adapted to resist substantial deformation in response to engagement of the drive bolt. In some embodiments, the functionality of the hardened surface may be achieved by one or more bearing members or inserts 148. Such an insert may be formed of metal or any other suitable material.

In some embodiments, insert 148 may include a bolt-receiving recess 150 for properly positioning the distal end 146 of the drive bolt. So provided, once the bolt is driven so that the distal end of the drive bolt engages the insert, downward force of the bolt is transferred to the closure lid, thereby urging a seating surface 152 of the closure lid against a closure lid-receiving ledge 154. Additionally, in reaction to the downward force of the bolt, the outer retaining member 155 of the compression link is urged upwardly so that the engagement surface 132 engages the closure lid-retention surface 134, thereby retaining the closure lid in its locked or sealed position.

In order to facilitate a more secure sealing of the closure lid, some embodiments may incorporate a gasket 156 which is adapted to engage in a sealing relationship with the closure lid and the canister shell, such as by being received within a gasket recess 158 of the closure lid and engaging a surface defining the recess as well as seating surface 152 of the canister shell. So provided, engagement of the compression link with the closure lid and canister shell places axial, tensile force in that portion of the canister shell located between the closure lid-retention surface and the closure lid-receiving ledge, while exerting a compressive force on the closure lid. This is accomplished with the bolts of the compression links not being attached to or through the seating surface of the closure lid or the closure lid-receiving ledge of the canister shell.

Figure 6:
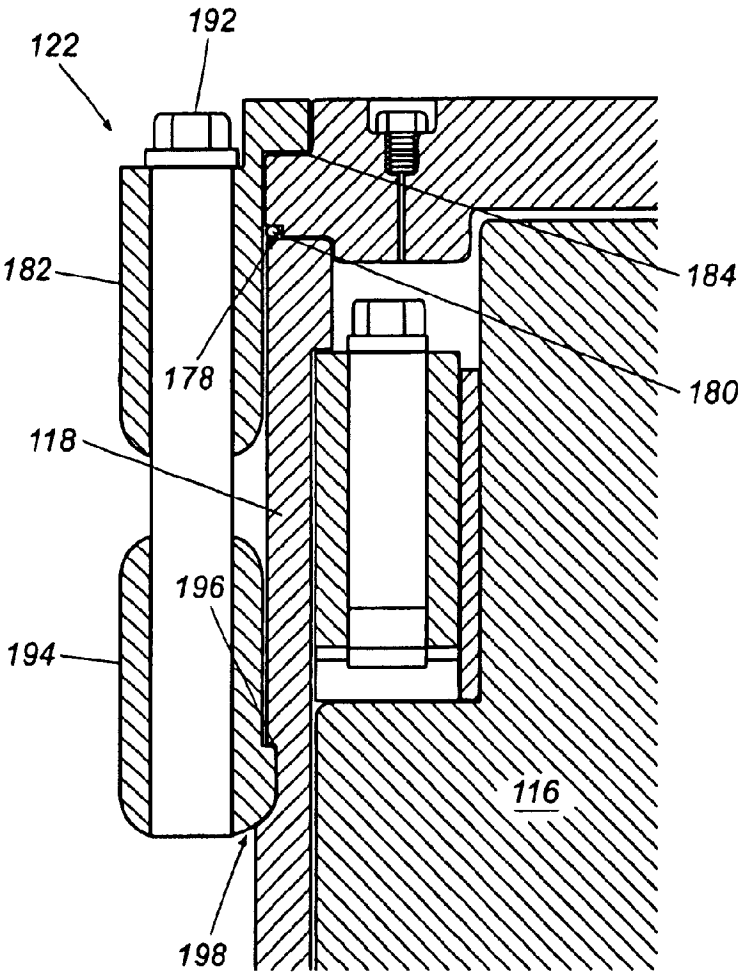
FIG. 6 is a partially cut-away, cross-sectional, side view of a preferred outer lid of the present invention.
Figure 5:
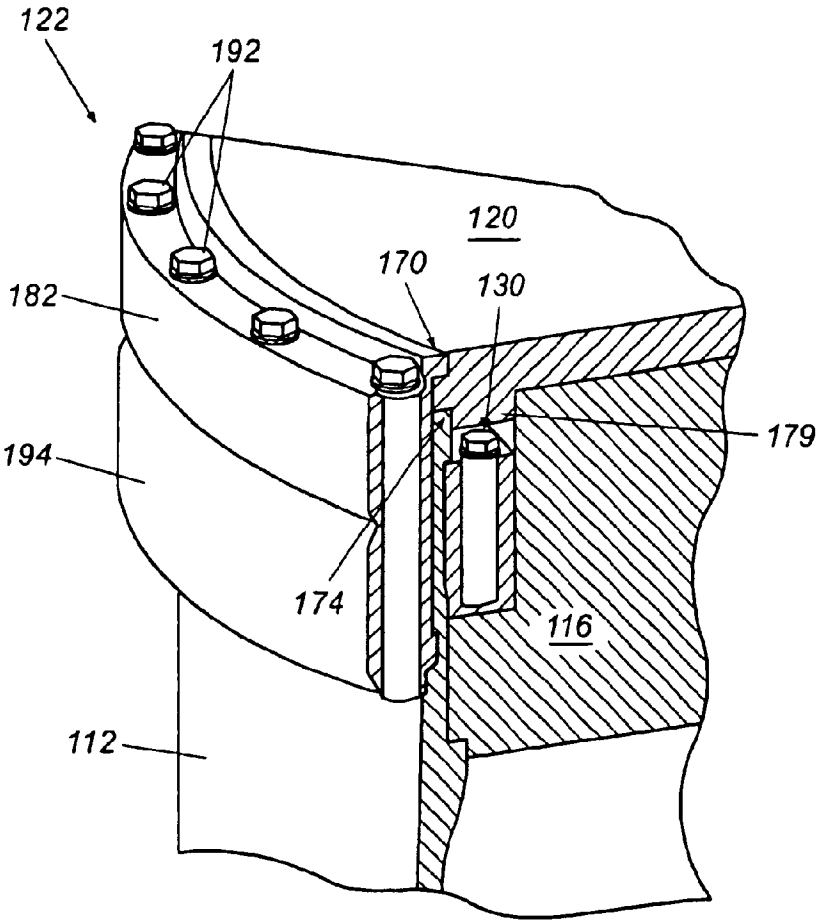
FIG. 5 is a partially cut-away, partially cross-sectional, perspective view showing detail of a preferred outer lid of the present invention.

Referring now to FIGS. 5 and 6, outer lid 120 and its associated components will now be described. As shown in FIG. 5, outer lid 120 is adapted to cooperate with canister shell 112 so that closure lid 116 is disposed between the outer lid and the interior of the canister. Although capable of numerous configurations, outer lid 120 preferably incorporates a hold down-receiving recess 170 formed along an upper edge thereof and an opposing seating surface 174 which is adapted to engage a distal end of the canister shell. Seating surface 174 may incorporate a gasket recess 178 which is adapted to receive a gasket 180 for promoting sealing engagement of the outer lid with the canister shell. Additionally, an alignment protrusion 179 may be provided on a underside of the outer lid that is adapted to be received by the annular region 130, so that the outer lid may be appropriately aligned with the closure lid and canister shell.

Preferably, lid hold-down member 122 incorporates an upper ring 182 which is adapted to be received about the distal end of the canister shell and the outer lid, with an outer lid hold-down ledge 184 protruding from an inner surface of the ring. The hold-down ledge 184 is adapted to be received by the hold-down receiving recess 170 of the outer lid. A plurality of connectors 192, e.g., bolts, depend from the ring, with each of the connectors engaging a lid hold-down segment 194. Each lid hold-down segment is configured as an arcuate segment with an inner diameter which is appropriately configured so that each segment may be received about an exterior surface of the canister shell. In order to facilitate sealing engagement of the outer lid with the canister shell, each lid hold-down segment preferably incorporates an outer lid-retaining ledge 196 which extends inwardly from its respective segment. The aforementioned outer lid-retaining ledges are adapted to engage within a compression recess 198 formed in an outer surface of the canister shell. So configured, when the connectors are tightened, each lid hold-down segment is urged toward the ring, thereby causing the outer lid-retaining ledge 196 to engage the compression recess 198 of the canister and the outer lid hold-down ledge 184 of the ring 182 to engage the hold-down receiving recess 170 of the outer lid. Thus, when so tightened, the outer lid is held in compression against the canister shell.

The foregoing description has been presented for purposes of illustration and description. It is not intended to be exhaustive or to limit the invention to the precise forms disclosed. Modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. A storage system comprising:

a container having a wall with an outer surface and an inner surface and a first open end, said container defining an interior;

a closure lid configured to be inserted within said open end and adapted to engage in a sealing relationship with said inner surface; and a compression link having a container engagement surface and a closure lid engagement surface, said compression link being configured to engage between said closure lid and said inner surface to retain said closure lid in sealing engagement with said container, said container engagement surface and said closure lid engagement surface being configured to extend outwardly from each other, said container engagement surface being adapted to contact said inner surface and said closure lid engagement surface being adapted to engage said closure lid such that, said closure lid is retained in sealing engagement with said inner surface.

2. The storage system of claim 1, wherein said inner surface has a closure lid retention ledge formed thereon, and wherein said container engagement surface of said compression link is adapted to engage said closure lid retention ledge.

3. The storage system of claim 1, wherein said closure lid has a stepped outer surface defining an annular region, and wherein said compression link is adapted to be received within said annular region.

4. The storage system of claim 1, wherein said inner surface has a recess formed therein for receiving at least a portion of said compression link.

5. The storage system of claim 1, further comprising a backing member adapted to be inserted between said closure lid and said compression link such that insertion therebetween urges said compression link radially outwardly from said closure lid and positions said container engagement surface of said compression link for engagement with said inner surface.

6. The storage system of claim 1, further comprising:

an outer lid configured for engaging a distal end of said container such that said closure lid is disposed between said outer lid and said interior.

7. The storage system of claim 6, wherein said outer lid has a lid hold-down member associated therewith for retaining said outer lid in sealing engagement with said container.

8. The storage system of claim 7, wherein said outer surface has a recess formed therein, and wherein said hold-down member has a retention ledge configured to engage said recess.

9. The storage system of claim 1, further comprising:

a bearing member configured to fit between said closure lid engagement surface and said container engagement surface of said compression link, wherein said bearing member engages said closure lid.

10. The storage system of claim 9, wherein said closure lid has a stepped outer surface, said stepped outer surface being adapted to engage said bearing member.

11. The storage system of claim 10, wherein said stepped outer surface is made of a surface harder than said bearing member.

12. The storage system of claim 1, further comprising:

an exothermic material, wherein said exothermic material has been inserted within said container and sealed therein.

13. The storage system of claim 12, wherein said exothermic material is spent nuclear fuel.

14. The storage system of claim 1, wherein said closure lid lacks holes for mechanical fasteners.

15. A method for storing a material comprising:

providing a container having a single wall with an inner surface and an outer surface, and a first open end, said container defining an interior;

providing a closure lid adapted to be received within the open end and adapted to engage in a sealing relationship with said inner surface;

providing a compression link having a container engagement surface and a closure lid engagement surface; and engaging said compression link between said closure lid and said inner surface such that said closure lid is retained by placing a portion of the closure lid under compression and a corresponding portion of inner surface under tension with said compression link contacting both said closure lid and said inner surface.

16. The method of claim 15, further comprising the steps of:

providing an outer lid configured for engaging a distal end of the container such that the closure lid is disposed between the outer lid and the interior; and retaining the outer lid in sealing engagement with the container.

17. The method of claim 15, further comprising the steps of: providing a backing member; and inserting the backing member between the closure lid and the compression link such that insertion therebetween urges the compression link radially outwardly from the closure lid.

18. The method of claim 15, further comprising the steps of:

providing a bearing member;

inserting the bearing member between a portion of the compression link; and engaging said bearing member with said closure lid.

19. The method of claim 15, further comprising the step of:

inserting an exothermic material within the container prior to sealing the closure lid.

20. The method of claim 19, wherein the exothermic material is spent nuclear fuel.

21. A storage system comprising:

a container having a wall and a first open end, said wall having an inner surface and an outer surface;

a closure lid configured to be inserted within said open end and adapted to engage in a sealing relationship with said inner surface;

a compression link having a container engagement surface and a closure lid engagement surface, said compression link being configured to engage between and contact said closure lid and said inner surface to retain said closure lid in sealing engagement with said container; and an outer lid configured to engage a distal end of said container, wherein said outer lid has a lid hold-down member associated therewith for retaining said outer lid by exerting force on said outer surface of said wall of said container.

22. The storage system of claim 21, wherein said container is a single-walled container.

23. The storage system of claim 21, further comprising a backing member adapted to be inserted between said closure lid and said compression link such that insertion therebetween urges said compression link radially outwardly from said closure lid and positions said container engagement surface of said compression link for engagement with said inner surface.

24. The storage system of claim 21, wherein said inner surface has a recess formed therein for receiving at least a portion of said compression link.

25. The storage system of claim 21, further comprising:

a bearing member configured to fit between said closure lid engagement surface and said closure lid engagement surface, wherein said bearing member engages said closure lid.

26. The storage system of claim 21, wherein said closure lid has a stepped outer surface for receiving said bearing member.

27. The storage system of claim 21, wherein said outer surface has a recess formed therein, and wherein said lid hold-down member has a retention ledge configured to engage said recess.

28. The storage system of claim 21, further comprising:

an exothermic material, wherein said exothermic material has been inserted within said container and sealed therein.

29. The storage system of claim 28, wherein said exothermic material is spent nuclear fuel.

30. The storage system of claim 28, further comprising:

a basket configured to be inserted within said container for storing said exothermic material, wherein said basket is comprised of a neutron absorbing material.

31. A storage system comprising:

a container defining an interior and having an open end and a wall, the wall having an outer surface and an inner surface;

the inner surface of the container having a first annular ledge and a first annular recess, the first annular ledge extending into the interior of the container, the first annular recess being located about a circumference of the inner surface and between the first annular ledge and the open end, the first annular recess having an upper surface;

a closure lid sized and shaped to be inserted within the open end of the container and to engage in a sealing relationship with the inner surface of the wall, the closure lid having a second annular recess formed about an outer periphery thereof, the second annular recess being defined by a lower surface, the closure lid being movable between an open position, in which the closure lid is disengaged from a sealing relationship with the container, and a closed position, in which the closure lid is inserted within the open end of the container and contacts and is supported by the first annular ledge, the first annular ledge preventing further movement of the closure lid into the interior of the container; and a compression link sized and shaped to engage between and contact the closure lid and the inner surface to retain said closure lid in sealing engagement with said container, the compression link having a container engagement surface and a closure lid engagement surface, the container engagement surface and said closure lid engagement surface being operative to extend outwardly from each other such that, when the closure lid is in the closed position and the compression link is positioned to retain the closure lid in the sealing relationship with the container, said container engagement surface contacts the upper surface of the first annular recess of the inner wall and the closure lid engagement surface contacts the lower surface of the second annular recess of the closure lid.

32. The storage system of claim 31, further comprising:

a second annular recess located about a circumference of the outer wall of the container;

an outer lid sized and shaped to contact and engage in a sealing relationship with a distal end of the container, the outer lid being movable between an open position, in which the outer lid is disengaged from a sealing relationship with the container, and a closed position, in which the outer lid is engaged in the sealing relationship with the distal end of said container such that, when the closure lid and the outer lid are in respective closed positions, the closure lid is disposed between said outer lid and said interior of the container; and a hold-down member operative to retain the outer lid in the sealing engagement with the container, the hold-down member having a ring, an arcuate segment and a connector extending between the ring and the arcuate segment, the ring having an annular ledge extending radially inwardly therefrom, the arcuate segment having an arcuate ledge extending inwardly therefrom, the connector being operative to selectively urge the ring and arcuate segment toward each other or away from each other;

wherein, when the outer lid is in the closed position and the hold-down member is retaining the outer lid in the sealing engagement with the container, the annular ledge of the ring contacts the outer lid, and the arcuate ledge of the arcuate segment contacts the second annular recess of the outer wall of the container.

33. The storage system of claim 31, further comprising:

a backing member sized and shaped to be inserted between the closure lid and the compression link such that insertion therebetween urges the compression link radially outwardly from the closure lid and positions the container engagement surface of the compression link for engagement with the inner surface such that at least a portion of the compression ink is located within the first annular recess of the inner surface of the container.

34. The storage system of claim 31, further comprising:

a ring-shaped bearing member configured to be positioned between the closure lid engagement surface and the container engagement surface of the compression link, the ring-shaped bearing member being formed of a harder material than the closure lid, the ring-shaped bearing member having a recess such that, when the ring-shaped bearing member is positioned between the closure lid engagement surface and the container engagement surface of the compression link, the closure lid engagement surface contacts the ring-shaped bearing member within the recess.

35. The storage system of claim 31, further comprising:

an exothermic material inserted within the container.

* * * * *